United States Patent [19]

Bateman

[11] Patent Number: 5,012,140

[45] Date of Patent: Apr. 30, 1991

[54] LOGARITHMIC AMPLIFIER WITH GAIN CONTROL

[75] Inventor: Glenn Bateman, Redmond, Oreg.

[73] Assignee: Tektronix, Inc., Beaverton, Oreg.

[21] Appl. No.: 495,191

[22] Filed: Mar. 19, 1990

[51] Int. Cl.[5] ..... G06G 7/10; G06G 7/24; G06G 7/12

[52] U.S. Cl. ..... 307/491; 307/492; 307/493; 328/145

[58] Field of Search ..... 307/492, 493, 494, 494, 307/500, 553, 555, 577, 284, 491, 490; 328/145; 330/86, 282, 284

[56] References Cited

U.S. PATENT DOCUMENTS

| | | | |
|---|---|---|---|
| 3,678,947 | 7/1972 | Glathe | 307/492 |
| 3,928,774 | 12/1975 | Wilson | 328/145 |
| 4,084,129 | 4/1978 | Katakura | 330/282 |
| 4,125,789 | 11/1978 | Van Schoiack | 307/494 |
| 4,346,311 | 8/1982 | Ave et al. | 307/555 |
| 4,418,317 | 11/1983 | Bateman | 321/145 |
| 4,471,324 | 9/1984 | Welland | 330/86 |
| 4,507,615 | 3/1985 | Bateman | 307/492 |
| 4,739,283 | 4/1988 | Metz et al. | 330/284 |

FOREIGN PATENT DOCUMENTS

| | | | |
|---|---|---|---|
| 1117660 | 10/1984 | U.S.S.R. | 307/492 |

*Primary Examiner*—Stanley D. Miller
*Assistant Examiner*—Toan Tran
*Attorney, Agent, or Firm*—Peter J. Meza; William K. Bucher

[57] ABSTRACT

A logarithmic amplifier includes a first diode wherein the anode receives an input signal input signal current and a standing current. The cathode of the first diode is coupled to the emitter of a PNP transistor. The collector of the PNP transistor is coupled to the anode of a second diode. A bias current is added to the emitter and substracted from the collector of the PNP transistor to provide a lower emitter impedance. The cathode of the second diode is coupled to a negative supply voltage through a load resistor. A feedback network including an emitter coupled pair of NPN transistors samples the voltage at the anode of the second diode and sinks a current from the base of the PNP transistor. The voltage at the anode of the first diode is amplified to provide a logarithmic output voltage. The output voltage may be attenuated and applied to the base of the PNP transistor.

17 Claims, 2 Drawing Sheets

LOGARITHMIC AMPLIFIER WITH GAIN CONTROL

BACKGROUND OF THE INVENTION

This invention relates to logarithmic amplifiers, and more particularly, to logarithmic amplifiers wherein the gain is easily changed to accomodate a range of input signal currents. Logarithmic amplifiers are used in applications where there is a need to compress an input having a large dynamic range into an output having a small dynamic range. However, in prior art logarithmic amplifiers, the linear gain factor imposed on the logarithmic output voltage was either a fixed function or not easily changed. What is desired is a logarithmic amplifier having an easily changible gain in order that a range of input signal currents may be accomodated and in order that the dynamic range requirements of linear amplifiers following the logarithmic amplifier may be relaxed.

SUMMARY OF THE INVENITON

Therefore, according to the present invention, a logarithmic amplifier includes a first diode wherein the anode receives an input signal current and a standing current. The cathode of the first diode is coupled to the emitter of a PNP transistor. The collector of the PNP transistor is coupled to the anode of a second diode. A bias current is added to the emitter and subtracted from the collector of the PNP transistor to provide a lower emitter impedance. The cathode of the second diode is coupled to a negative supply voltage through a load resistor. A feedback network including an emitter coupled pair of NPN transistors samples the voltage at the anode of the second diode and sinks a current from the base of the PNP transistor. The voltage at the anode of the first diode is amplified to provide a longarithmic output voltage. The output voltage may be attenuated and applied to the base of the PNP transistor.

A feature of the present invention is to provide a logarithmic amplifier wherein the gain is easily adjustable.

Another feature of the present invention is to provide a logarithmic amplifier wherein the gain may be optimized to provide a maximum dynamic range of output voltage for a given input current.

Yet another feature of the present invention is to provide a logarithmic amplifier that is capable of operating at high frequencies greater than 100 Mhz.

These and other features of the present invention will be more readily understood by those skilled in the art from a reading of the following detailed specification and drawing figures.

DESCRIPTION OF THE PREFERRED EMBODIMENT

Figure 1:
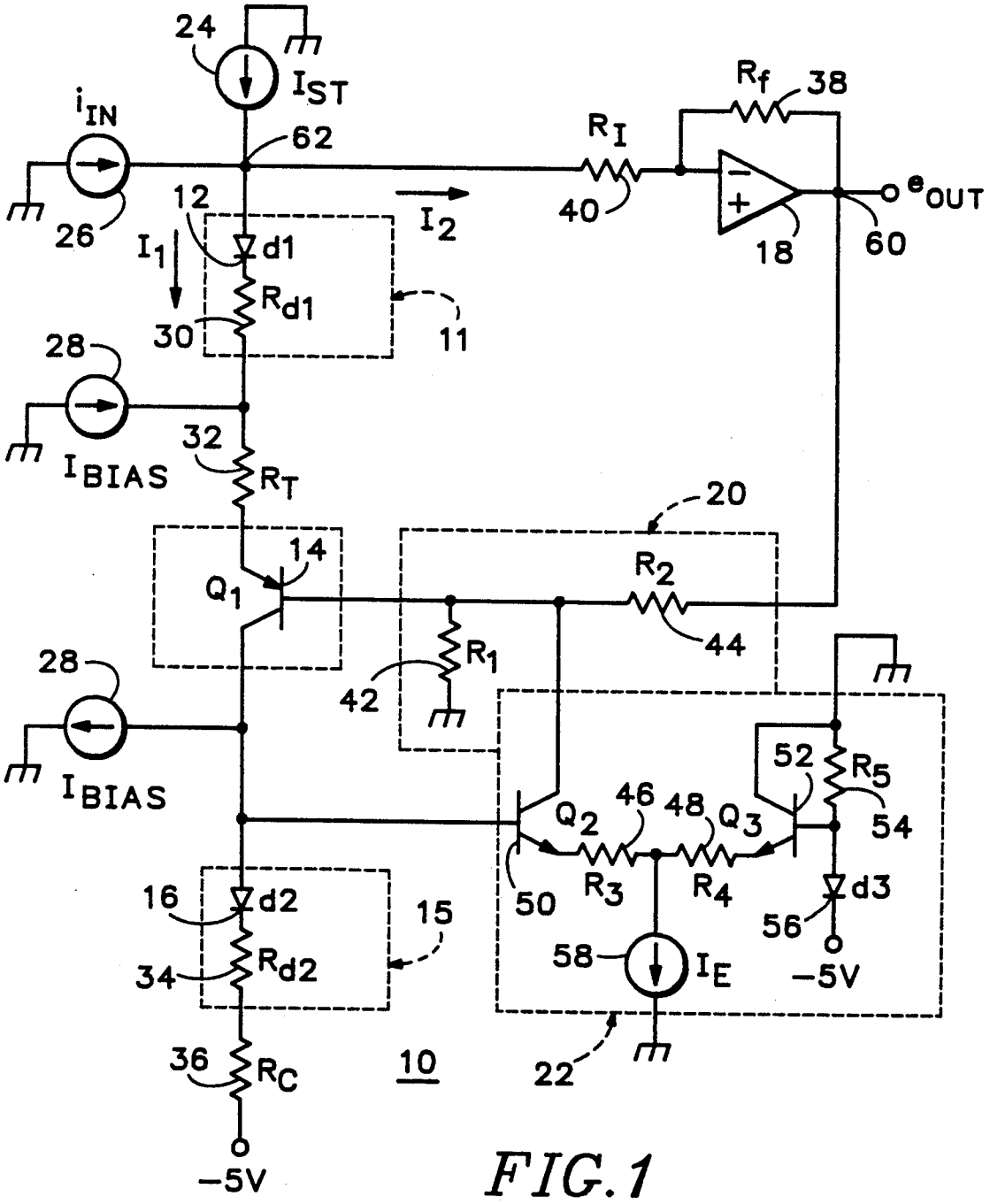
FIG. 1 is a schematic diagram of a logarithmic amplifier according to the present invention.

A logarithmic amplifier 10 according to the present invention is shown in the schematic diagram of FIG. 1. The anode of a first diode 11 receives a portion of an input signal current 26, $i_{IN}$, and a standing or biasing current 24, $I_{ST}$, at node 62. The portion of the input signal current that flows into the first diode 11 is designated $I_1$. Diode 11 is shown as consisting of an ideal diode 12 designated d1 and a parasitic resistance 30 designated $R_{d1}$. A PNP transistor 14 has an emitter coupled to the cathode of the first diode 11. PNP transistor 14 is shown as consisting of an ideal transistor $Q_1$ and a parasitic resistance 32 designated $R_T$. A bias current 28 designated $I_{BIAS}$ is added to the standing current 24 at the emitter of PNP transistor 14. The same bias current 28 is subtracted from the collector of PNP transistor 14. The bias current 28 flows only through PNP transistor 14 and is used to decrease the emitter impedance of the transistor. The anode of a second diode 15, shown as ideal diode 16 designated d2 and a parasistic resistance 34 designated $R_{d2}$, is coupled to the collector of PNP transistor 14. A load element, resistor 36 designated $R_C$ couples the cathode of the second diode 15 to a −5 volt power supply.

A feedback network 22 samples the voltage at the anode of the second diode 15 and compares this voltage to a reference voltage. The output of the feedback network 22 is an error current that is coupled to the base of PNP transistor 14. The means for generating the error current includes NPN transistors 50 and 52 designated $Q_2$ and $Q_3$. The emitters of NPN transistors 50 and 52 are coupled together and to an emitter current source 58 designated $I_E$ through emitter resistors 46 and 48, designated $R_3$ and $R_4$ to form a differential amplifier. Thus an output error current is formed at the collector of NPN transistor 50 if the voltage at the base of NPN transistor 50 is unequal to the voltage at the base of NPN transistor 52. The voltage at the base of NPN transistor 52 is provided by a reference voltage generator including a bias element, resistor 54 designated $R_5$, and a third diode 56 designated d3. The voltage provided by the reference voltage generator tracks the thermal variations in the voltage at the anode of the second diode 15. Therefore the error current at the collector NPN transistor 50 is only a function of the voltage at the anode of the second diode 15 attributable to the input signal current, $i_{IN}$.

A second current path is established through an input resistor 40 designated $R_I$ and a feedback resistor 38 designated $R_f$. The current flowing through the input resistor 40 and feedback resistor 38 is designated $I_2$. Operational amplifier 18 that is configured to provide a negative gain equal to $R_f/R_I$ amplifies the voltage at node 62 to provide the output voltage at node 60 designated $e_{OUT}$.

The logarithmic output voltage $e_{OUT}$ is attenuated by an attenuation network 20 and applied to the base of PNP transistor 14. The attenuation network 20 includes a series resistance 44 designated $R_2$ and a shunt resistance 42 designated $R_1$.

For a more thorough understanding of the operation of logarithmic amplifier 10, the following additional voltages are defined: $e_1$ is the voltage at node 62, $e_2$ is the voltage at the cathode of ideal diode d1, $e_3$ is the voltage at the anode of the second diode 15, and $e_4$ is the voltage at the base of PNP transistor 14. These voltages, together with previously defined voltages and currents may be used to derive the logarithmic output voltage with respect to a linear input current.

Starting with first principles, the diode equation is given by:

$$e = K \ln\left(\frac{I}{I_S} + 1\right),$$

where $$K = \frac{nkt}{q}$$

and $I_S$=saturation current. However, if a standing current is used to bias the diode, the diode equation is modified:

$$e = K \ln\left(\frac{I}{I_S + I_{ST}} + 1\right),$$

where $I_{ST}$=standing current. If $I_{ST} >> I_S$, then the diode equation is simply given by:

$$e = K \ln\left(\frac{I}{I_{ST}} + 1\right).$$

Equations [1] and [2] are obtained by inspection of the schematic diagram of FIG. 1:

$$I_{IN} = I_1 + I_2 \quad [1]$$

$$e_2 = e_4 + I_1(R_{d1} + R_T) \quad [2]$$

Equations [3A] and [3B] are obtained by superposition of the attenuation of the output voltage $e_{OUT}$ and the voltage produced by the error current from the collector of transistor 50 through the parallel combination of resistors 42 and 44. Thus:

$$e_4 = \frac{e_{OUT}R_1}{R_1 + R_2} - \frac{e_3 R_1}{R_3 + R_4} \text{ and} \quad [3A]$$

$$e_4 = e_{OUT}A_x - e_3 b, \quad [3]$$

$$\text{where } A_x = \frac{R_1}{R_1 + R_2} \text{ and } b = \frac{R_1}{R_3 + R_4}.$$

The voltage at the anode of diode 15, $e_3$, and the output voltage, $e_{OUT}$ in terms of $e_1$ is given by equations [4] and [5]:

$$e_3 = K \ln\left(\alpha \frac{I_1}{I_{S2}} + 1\right) + \alpha I_1(R_{d2} + R_C) \text{ and} \quad [4]$$

$$e_{out} = -e_1 \frac{R_f}{R_I}. \quad [5]$$

Substituting equations [4] and [5] into equation [3] gives:

$$e_4 = -e_1 R_f \frac{A_x}{R_I} - bK \ln\left(\alpha \frac{I_1}{I_{S2}} + 1\right) - b\alpha I_1(R_{d2} + R_C) \text{ and} \quad [6]$$

$$e_2 = -e_1 R_f \frac{A_x}{R_I} - bK \ln\left(\alpha \frac{I_1}{I_{S2}} + 1\right) - \quad [7]$$

-continued $$b\alpha I_1(R_{d2} + R_C) + I_1(R_{d1} + R_T).$$

Combining terms gives:

$$e_4 = -e_1 R_f \frac{A_x}{R_I} - bK \ln\left(\alpha \frac{I_1}{I_{S2}} + 1\right) + I_1(R_{d1} + R_T - \alpha b(R_{d2} + R_C)). \quad [8]$$

Adjusting $R_C$ such that $\alpha b(R_{d2}+R_C)=R_{d1}+R_T$ gives:

$$e_2 = -\frac{e_1 R_f A_x}{R_I} - bK \ln\left(\alpha \frac{I_1}{I_{S2}} + 1\right) \text{and} \quad [9]$$

$$e_1 = K \ln\left(\frac{I_1}{I_{S1}} + 1\right) - \frac{e_1 R_f A_x}{R_I} - bK \ln\left(\alpha \frac{I_1}{I_{S2}} + 1\right). \quad [10]$$

Note that the correct selection of the value of $R_C$ eliminates the parasitic resistance elements $R_{d1}$, $R_{d2}$, and $R_T$. By using a high beta transistor for $Q_1$, $\alpha$ approaches one. Thus there is minimal error if $\alpha$ is set to one. Assuming $I_{S1} = I_{S2}$ and combining terms gives:

$$e_1 = (1 - b)K \ln\left(\frac{I_1}{I_{S1}} + 1\right) - \frac{e_1 R_f A_x}{R_1}. \quad [11]$$

Solving for $e_1$ gives:

$$e_1\left(1 + \frac{R_f A_x}{R_1}\right) = (1 - b)K \ln\left(\frac{I_1}{I_{S1}} + 1\right), \quad [12]$$

$$e_1 = \frac{(1 - b)K}{\left(1 + \frac{R_f A_x}{R_1}\right)} \ln\left(\frac{I_1}{I_{S1}} + 1\right), \quad [12A]$$

or, alternatively:

$$\exp e_1\left(\frac{R_1 + R_f A_x}{(1 - b)KR_1}\right) = \frac{I_1}{I_{S1}} + 1 \text{ or} \quad [13]$$

$$I_1 = I_{S1}\left(\exp e_1\left(\frac{R_1 + R_f A_x}{(1 - b)KR_1}\right) - 1\right). \quad [14]$$

$$\text{Since } e_1 = -\frac{e_{OUT}R_1}{R_f},$$

$$I_1 = I_{S1}\left(\exp \frac{e_{OUT}}{R_f}\left(\frac{R_1 + R_f A_x}{(1 - b)KR_1}\right) - 1\right) \quad [15]$$

and since $I_2 = \frac{-e_{OUT}}{R_f}$, and substituting into [1] then:

$$I_{IN} = I_{S1}\left(\exp \frac{e_{OUT}}{R_f}\left(\frac{R_1 + R_f A_x}{(1 - b)KR_1}\right) - 1\right) - \frac{e_{OUT}}{R_f}. \quad [16]$$

Figure 2:
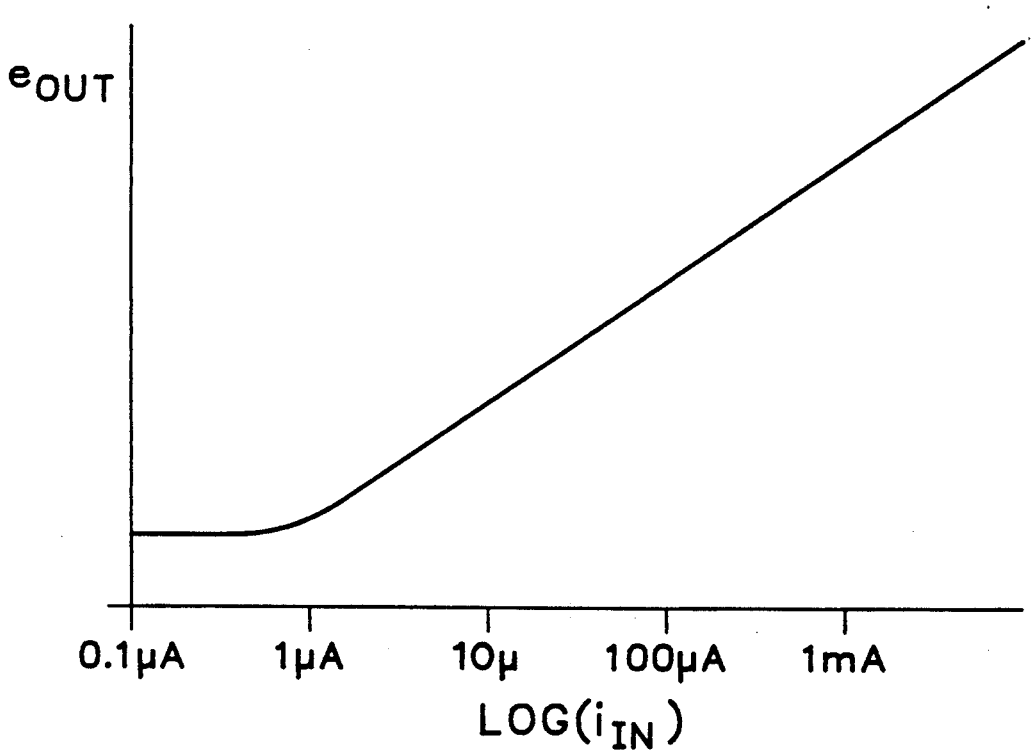
FIG. 2 is a plot of the output voltage that is a logarithmic function of the input signal current.

Equation [16] is the final equation that demonstrates the logarithmic output voltage with respect to a linear input current. It is important to note that the undesirable effect of the parasitic resistance in the diodes and PNP transistor on the logarithmic gain characteristic has been removed. However, this equation is transcendental and the output voltage, $e_{OUT}$, cannot be written as a direct function of the input current, $I_{IN}$. Therefore the graphical representation of equation [16] is shown in FIG. 2. FIG. 2 is a graph that shows the output voltage as a function of the logarithm of the input signal current. For currents higher than approximately 1 μA, the logarithmic amplifier according to the present invention provides a logarithmic output that is represented by a staight line on the graph. For currents less than 1 μA, the output voltage is a linear function of the input current and is represented by the curved line on the graph. This linear portion of the gain characteristics of the logarithmic amplifier is useful for averaging low level input signal currents to ascertain the signal level as the noise level becomes significant.

The gain of the amplifier may be easily changed as can be seen from the form of equation [16]. For example, if high dynamic range is required with low input signal currents, the following component values may be desirable:

$R_1=150\Omega$
$R_2=10K\Omega$
$R_f=300K\Omega$
$R_I=1K\Omega$
$I_{ST}=1\ \mu A$ As another example, if maximum bandwidth up to 30 Mhz is required for high signal current levels, the following component values may be desirable:

$R_1=150\Omega$
$R_2=\infty$
$R_f=30K\Omega$
$R_I=1K\Omega$
$I_{ST}=50\ \mu A$

Other remaining component values that may be desirable for either example are:

$I_{BIAS}=3$ mA
$I_E=6$ mA
$R_3=R_4=120\Omega$
$R_5=47K\Omega$

For optimum frequency performance it is further desirable that Schottky diodes be used for diodes 11 and 15.

Under appropriate operating conditions, an alternative embodiment may be used wherein the attenuation factor, $A_x$, is set to zero. This is accomplished by removing resistors $R_I$, $R_f$, $R_2$, and the operational amplifier 18. In this embodiment, equation [12A] simplifies to:

$$e_1 = (1 - b)K \ln\left(\frac{I_1}{I_{S1}} + 1\right), \qquad [12B]$$

Thus, there has been described and illustrated herein a logarithmic amplifier having a logarithmic characteristic that is not a function of the parasitic resistance of the diodes and transistors used and provides and easily adjustable gain that may be optimized to the level of input current. It will be obvious to those having skill in the art that many changes may be made in the above-described details of the preferred embodiment without departing from the true spirit of the invention. For example, the polarity of the transistors may be changed with an appropriate change in polarity of the biasing voltages and currents. The scope of the invention is limited only by the following claims.

I claim:

1. A logarithmic amplifier comprising:

(a) a first non-linear element having an input terminal for receiving an input signal current and an output terminal;

(b) a first transistor having a first controlled terminal coupled to the output terminal of the first non-linear element, a second controlled terminal and a control terminal;

(c) a second non-linear element having an input terminal coupled to the second controlled terminal of the first transistor and an output terminal;

(d) a load element having a first terminal coupled to the output terminal of the second non-linear element and a second terminal coupled to a first source of supply voltage;

(e) a feedback network having an input terminal coupled to the input terminal of the second non-linear element and an output terminal coupled to the control terminal of the first transistor;

(f) means for amplifying having an input terminal coupled to the input terminal of the first non-linear element and an output terminal for providing a logarithmic output voltage and;

(g) an attenuation network for attenuating the logarithmic output voltage and applying the attenuated output voltage to the control terminal of the first transistor.

2. A logarithmic amplifier as in claim 1 further comprising a source of standing current coupled to the input terminal of the first non-linear element.

3. A logarithmic amplifier as in claim 1 further comprising a first source of bias current coupled to the first controlled terminal of the first transistor and a second source of bias current having a magnitude equal to the magnitude of the first source of bias current but opposite in direction, the second source of bias current being coupled to the second controlled terminal of the first transistor.

4. A logarithmic amplifier as in claim 1 wherein the first and second non-linear elements each comprises a Schottky diode having an anode coupled to the input terminal and a cathode coupled to the output terminal.

5. A logarithmic amplifier as in claim 1 wherein the first transistor comprises a bipolar PNP transistor having an emitter coupled to the first controlled terminal, a base coupled to the control terminal, and a collector coupled to the second controlled terminal.

6. A logarithmic amplifier as in claim 1 wherein the feedback network comprises:

(a) a second transistor having a base coupled to the input terminal of the second non-linear element, a collector coupled to the control terminal of the first transistor, and an emitter; and (b) a third transistor having a base coupled to a reference voltage generator, a collector coupled to a second source of supply voltage, and an emitter coupled to the emitter of the second transistor and to a source of emitter current.

7. A logarithmic amplifier as in claim 6 wherein the reference voltage generator comprises:

(a) a bias element coupled between the second source of supply voltage and the base of the third transistor; and (b) a diode having an anode coupled to the base of the third transistor and a cathode coupled to the first source of supply voltage.

8. A logarithmic amplifier as in claim 6 wherein the feedback network further comprises a first emitter resistor coupled between the emitter of the second transistor and the source of emitter current and a second emitter resistor coupled between the emitter of the third transistor and the source of emitter current.

9. A logarithmic amplifier as in claim 1 wherein the means for amplifying comprises:

(a) an operational amplifier having a positive input coupled to the second source of supply voltage, a negative input, and an output;

(b) an input resistor coupled between the input terminal of the amplifying means and the negative input of the operational amplifier; and (c) a feedback resistor coupled between the output terminal of the amplifying means and the negative input of the operational amplifier.

10. An improved diode circuit having increased dynamic range and gain control for use in a logarithmic amplifier comprising:

(a) a first non-linear element having an input terminal for receiving an input signal current and an output terminal, the first non-linear element having a parasitic resistance equal to $R_{d1}$;

(b) a first transistor having a first controlled terminal coupled to the output terminal of the first non-linear element, a second controlled terminal and a control terminal, the first transistor having a parasitic resistance equal to $R_T$;

(c) a second non-linear element having an input terminal coupled to the second controlled terminal of the first transistor and an output terminal, the second non-linear element having a parasitic resistance equal to $R_{d2}$;

(d) a load element having a first terminal coupled to the output terminal of the second non-linear element and a second terminal coupled to a first source of supply voltage, the load element having a value of $R_C$ that compensates for the parasitic resistances $R_{d1}$, $R_T$, and $R_{d2}$; and (e) a feedback network having an input terminal coupled to the input terminal of the second non-linear element and an output terminal coupled to the control terminal of the first transistor.

11. The improved diode circuit as in claim 10 further comprising a source of standing current coupled to the input terminal of the first non-linear element.

12. The improved diode circuit as in claim 10 further comprising a source of bias current coupled to the first controlled terminal of the first transistor and a second source of bias current having a magnitude equal to the magnitude of the first source of bias current but opposite in direction, the second source of bias current being coupled to the second controlled terminal of the first transistor.

13. The improved diode circuit as in claim 10 wherein the first and second non-linear elements each comprise a Schottky diode having an anode coupled to the input terminal and a cathode coupled to the output terminal.

14. The improved diode circuit as in claim 10 wherein the first transistor comprises a bipolar PNP transistor having an emitter coupled to the first controlled terminal, a base coupled to the control terminal, and a collector coupled to the second controlled terminal.

15. The improved diode circuit as in claim 10 wherein the feedback network comprises:

(a) a second transistor having a base coupled to the input terminal of the second non-linear element, a collector coupled to the control terminal of the first transistor, and an emitter; and (b) a third transistor having a base coupled to a reference voltage generator, a collector coupled to a second source of supply voltage, and an emitter coupled to the emitter of the second transistor and to a source of emitter current.

16. The improved diode circuit as in claim 15 wherein the reference voltage generator comprises:

(a) a bias element coupled between the second source of voltage supply and the base of the third transistor; and (b) a diode having an anode coupled to the base of the third transistor and a cathode coupled to the first source of supply voltage.

17. The improved diode circuit as in claim 15 wherein the feedback network further comprises a first emitter resistor coupled between the emitter of the second transistor and the source of the emitter current and a second emitter resistor coupled between the emitter of the third resistor and the source of the emitter current.

* * * * *